United States Patent [19]

Takeda et al.

[11] 4,199,670

[45] Apr. 22, 1980

[54] MANUALLY RE-SET INERTIA SWITCH ASSEMBLY

[75] Inventors: Nobuhiro Takeda; Masaichi Hattori, both of Nagoya, Japan

[73] Assignee: Kabushiki Kaisha Tokai Rika Denki Seisakusho, Aichi, Japan

[21] Appl. No.: 935,082

[22] Filed: Aug. 18, 1978

[30] Foreign Application Priority Data

Aug. 31, 1977 [JP] Japan ..... 52-115639[U]

[51] Int. Cl.[2] ..... H01H 35/14

[52] U.S. Cl. ..... 200/61.45 R; 200/61.5

[58] Field of Search ..... 200/61.45 R, 61.48, 200/61.49, 61.5, 61.05, 61.51, 61.52, 318–326

[56] References Cited

U.S. PATENT DOCUMENTS

| | | | |
|---|---|---|---|
| 2,774,838 | 12/1956 | Bertrand | 200/318 X |
| 2,966,562 | 12/1960 | McElvain | 200/61.5 |
| 3,745,277 | 7/1973 | Shawcross et al. | 200/61.45 X |

FOREIGN PATENT DOCUMENTS

| | | | |
|---|---|---|---|
| 681462 | 9/1939 | Fed. Rep. of Germany | 200/326 |

*Primary Examiner*—James R. Scott

*Attorney, Agent, or Firm*—Wenderoth, Lind & Ponack

[57] ABSTRACT

An electric circuit breaker for automatically breaking a circuit affected by a motor vehicle collision, including an internal connecting member pivotally mounted on a casing and urged in a clockwise direction, a latch mounted on the forward end of a pivotal shaft extending through the internally connecting member, a lever secured to the pivotal shaft at one end and capable of pivoting in a counterclockwise direction through the movement of an inertia body urgedly held in a normal vertical position due to gravity by the other end of the lever urged downward, and an electrically connecting member pivotally mounted on the internally connecting member and urged counterclockwise, at one end of which a pawl is provided to engage with the latch while a movable electrical connector is provided at the other end with respect to the pivotal center.

6 Claims, 4 Drawing Figures

MANUALLY RE-SET INERTIA SWITCH ASSEMBLY

BACKGROUND OF THE INVENTION

The present invention relates to a breaker and more particularly to, an electric circuit breaker which is capable of instantaneously breaking an electric circuit in use in a motor vehicle, when the motor vehicle accidentally collides or is turned over, so as to prevent an accidental fire in the motor vehicle, triggered by a resultant short circuit in the electrical circuit.

According to the conventional arrangements, since the electric circuit breaker comprises a specific electric circuit in itself for controlling the actuation of the movable circuit connector, the defects resulting from snapping or disconnection of specific wires themselves accompanying the accident can not be avoided, often bringing about fatal disasters.

More specifically, as shown in FIG. 1, the typical electric circuit breaker M of the prior art includes a specific electric circuit, which comprises an electrical connecting-interrupting part 32 including an inertia body 31, said electrical part 32 usually being interrupted through lever means actuated by the inertia body 31, a solenoid operated latch 36, an electrical connecting member of the spring returning type having a movable, electrical connecting portion at one end 37 and engaged by the latch 36 to maintain a closed circuit C, and fixed electrically connecting portions 41 normally urged into contact by movable, electrically connecting portions 40 described above.

By the arrangement mentioned above, when the inertia body 31 is forced to oscillate or move toward a reverse state from that in which it has been maintained, for example, by an accidental, sudden automobile collision, the electrically connecting-interrupting part 32 of the specific, electric circuit 33-32-35-34 is electrically connected by the releasing action of the leverage due to the accidental movement of the inertia body 31 and thereby, the specific, electric circuit of the breaker 33-32-35-34 is electrically connected so that the engagement of the latch 36 and the electrical connecting member 37 is electromagnetically released to break the closed circuit C through an electromagnet 34 now energized. Therefore, as is clear from the foregoing description, the breaker of the above described type is only effected through a series of successive actuations, wherein the accidental impact physically brought about must first be transformed into the electrical signal in the specific electric circuit and then, the electrical signal is again transformed into the electromagnetic force which breaks the closed circuit.

Thus, according to the known arrangements as described above, the number of components, including the electric parts comprising the breaker is naturally increased and therefore, the resultant breaker can not be manufactured at low cost when compared with the breaker of the present invention.

Still furthermore, the inertia breaker of the above described type has only low reliability due to the fact that the provision of the specific electrical circuit, including its constituent parts inevitably gives rise to possibilities of snapping or disconnection of the internal wires and thus, of the non-actuation of the inertia breaker itself when desired.

SUMMARY OF THE INVENTION

Accordingly, an object of the present invention is to provide an electric circuit breaker, which does not include a specific electric circuit for controlling the actuations of a movable, electric connector thereof.

Another important object of the present invention is to provide an electric circuit breaker of the above described type, which is simple in structure, reliable and highly efficient in use.

A further object of the present invention is to provide an electric circuit breaker of the above described type, which can be manufactured at low cost.

In accomplishing these and other objects according to one preferred embodiment of the present invention, there is provided an electric circuit breaker, which comprises a casing, an internal connecting member pivotally mounted on the casing and urged in a clockwise direction with respect to a pivotal center mounted on the casing, a latch pivotally mounted on a forward end of a shaft which is mounted on the casing and extending through the internal connecting member, the latch having a semi-circular cross section, a lever secured to the shaft of the latch at one end thereof and capable of pivoting counterclockwise as caused by the oscillating movement of an inertia body, which is in a normal vertical position due to gravity by the other end of the lever which in turn is adjustably urged downward by an adjustable spring, and an electrical connecting member pivotally mounted on the internal connecting member through a pin and relatively urged in a counterclockwise direction with respect to the pin, said electrical connecting member having a pawl at one end to frictionally engage and maintain the side circumferential surface of the semi-circular cross section of the latch is a position for closing the electric circuit concerned. A movable, electrically connecting portion is also provided at the other end thereof with respect to the pivotal center of the electrical connecting member, the lower portion of said other end being connected by one end of an internal spring the other end of which is secured to the pin or the pivotal center of the internally connecting member mentioned above, and, a handle being provided on the electrically connecting member between both ends mentioned above.

More specifically, when the inertia breaker of the present invention is in an electrically closed state or stationary state, the electrical connecting member is arranged so that the pawl frictionally engages the semi-circular side of the latch with its head edge portion directed upward and thereby preventing the pawl from pivoting counterclockwise with respect to the pin, as a result of which, the movable, electrically connecting portion thereof is conversely urged toward the electrically connecting portion which is fixedly mounted on the casing through a leaf spring provided below.

By the arrangement described, the inertia breaker of the present invention does not include any specific, electrical circuits at all for controlling the actuation of the movable, electrical connector. A highly reliable inertia breaker or electric circuit breaker, which prevents technical defects resulting from the snapping or disconnection of the internal wire has been provided.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout the several views of the accompanying drawings.

DETAILED DESCRIPTION OF THE INVENTION

Figure 1:
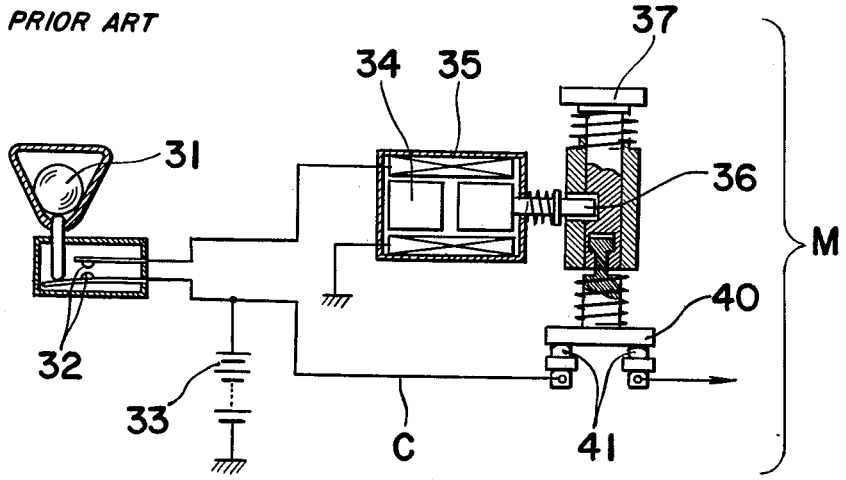
Fig. 1 PRIOR ART
FIG. 1 is a side elevational view, partly in section, of an electric circuit breaker of the conventional type in a closed state, with a specific electric circuit included.
Figure 2:
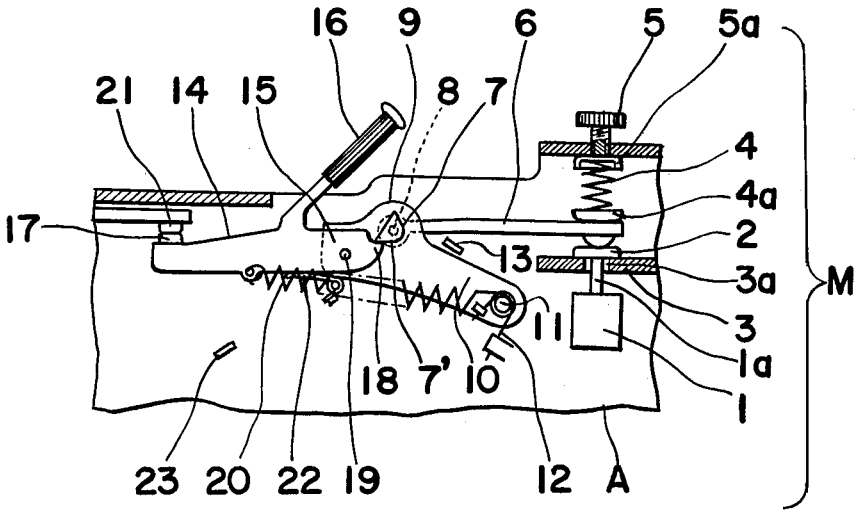
FIG. 2 is a side elevational view, partly in section, of an electric circuit breaker of the present invention, in a closed state, with the side casing being removed.
Figure 3:
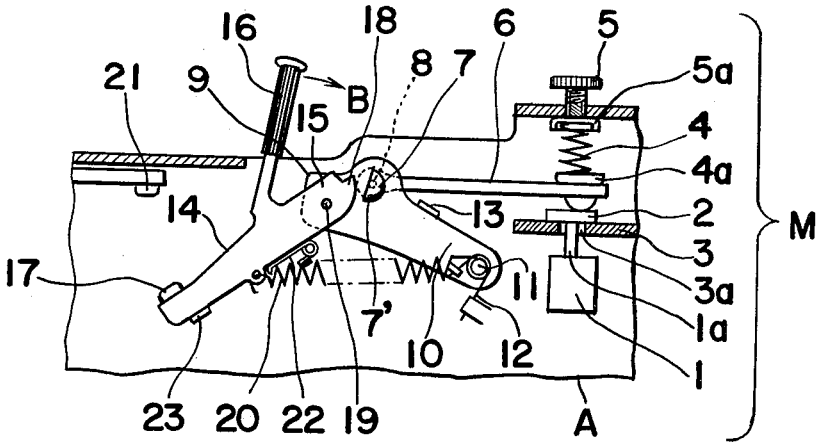
FIG. 3 is a view simmilar to FIG. 2, but particularly showing the breaker in an opened state.
Figure 4:
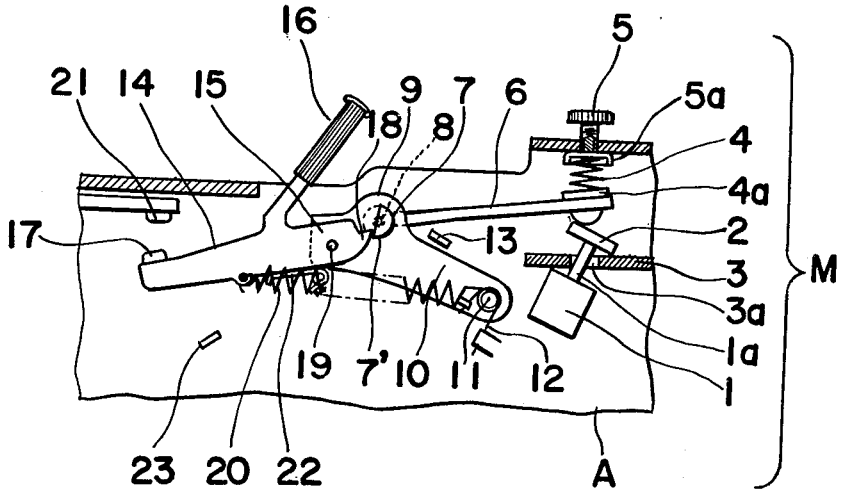
FIG. 4 is a view similar to FIG. 3, but particularly showing the handle during a change from the closed circuit condition to the open circuit condition.

Referring now to the drawings, there is shown in FIGS. 2 to 4, one preferred embodiment of the present invention, in which an electrical circuit breaker M comprises a casing A, an internal connecting member 9 pivotally mounted on the casing A, the internal connecting member 9 being urged clockwise with respect to a pivotal center or a pin 11 mounted on the casing A, a latch 7 pivotally mounted on a shaft 8 extending through said internal connecting member 9 and having a semicircular cross section, a lever 6 secured to the shaft 8 of the latch 7 at one end and capable of pivoting with respect to that end through the oscillating movement of an inertia body 1 urged into a normal vertical position due to gravity by the other end of the internal connecting member, and an electric connecting member 14 pivotally mounted on the internal connecting member 9 through a pin 19 and relatively urged counterclockwise with respect to the pivotal center 19, the electrical connecting member 14 having a pawl 18 at one end so as to be frictionally engaged and maintained by the side peripheral surface 7' of the semi-circular cross section of the latch 7, while a movable electric connecting portion 17 is also provided at the other end of the electrical connecting member, with a handle 16 connected to the electrical connecting member.

More specifically, FIG. 2 shows the parts in the closed circuit condition including the inertia breaker M therein, wherein an inertia body 1 having a head portion 2 connected thereto by a shaft portion **1*a* rests freely on a seat 3 provided on the outer casing A, with its head portion 2 resting on the seat 3 and the shaft portion 1*a* interconnecting the head portion 2 and the bulk 1 thereof extending through a relatively large opening 3*a* formed in the seat 3. Furthermore, the head portion 2 of the inertia body 1 resting on the seat mentioned above is urged into a fixed position toward the seat 3 by a spring 4 of an adjustable type, while the free end of the lever 6 having a rounded projection is interposed between a collar portion 4*a* of the adjustable spring 4 and the head portion 2 of the inertia body 1. The numeral 5 indicates a threaded bolt provided with a spring receiver 5*a* at the top end of the adjustable spring and extending through the casing A, the bolt 5 permitting a fine adjustment of the resilient force of the spring 4** which is urged in a downward direction.

The end opposite to the free end of the lever 6 is fixedly secured to a rotatable latch shaft 8, which extends through the internal, middle portion of the internal connecting member 9 and is provided at the forward end of the latch 7. By the arrangement described in the foregoing, both the lever 6 and the latch 7, as a whole, pivotally move counterclockwise, when the inertia body 1 is oscillated in any direction from the rest state as shown in FIG. 2, for example the upward direction as well as either the right hand side or the left hand side with respect to the substantially vertical axis of the inertia body held in a normal vertical position due to gravity.

As shown in FIG. 2, the internal connecting member 9 is pivotally mounted on the casing A through the pin 11 at a extension 10 and, urged clockwise and directed toward a stop 13 mounted on the casing A through the biasing force of a spring 12 mounted on the pin 11, one end of which is connected to the extension 10 itself, while the other end of the spring 12 is secured to the casing A. On one end opposite to the extension 10 of the internal connecting member 9, the electrical connecting member 14 is pivotally coupled to the internal connecting member 9 through the pin 19 at one end 15, while the lower portion of the other end of the electric connecting member 14 has connected thereto one end of an internal spring 20 in a stretched condition the other end of which is secured to the pin 11.

As described above, the electric connecting member 14 is provided with the pawl 18 at one circumferential edge frictionally maintained by the side outer circumference 7' of the latch 7 in a closed circuit state as well as at least one electric connecting portion or contact 17 at the other circumferential end, to be contacted and thereby, electrically connected to at least one fixed connector 21 provided on the casing A, while the handle 16 is provided at the location between the two members described above.

As shown in FIG. 2, when the inertia breaker of the present invention is in an electrically closed state, i.e., a stationary state of the device of the present invention, the electrical connecting member 14 is disposed such that the pawl 18 is frictionally engaged with the side circumferential surface of semi-circular shape 7' of the latch 7 with its head edge portion directed upward and thereby the pawl 18 is prevented from further pivoting counterclockwise with respect to the pin 19 due to the spring force of the spring 20, so that the movable electrically connecting portion 17 is conversely maintained in contact with the electrically connecting portion 21 fixedly mounted on the casing A.

Furthermore, a leaf spring 22 mounted on the casing A is provided for reinforcing the contact of the movable electrically connecting portion 17 with the fixed electric connector 21. The numeral 23 indicates a stop provided for the electrical connecting member 14.

The operation of the inertia breaker of the present invention are as follows.

When the inertia body 1 of the inertia breaker of the present invention, which has been in a closed state, is horizontally accelerated, for example, due to collision between motor vehicles in an accident, the inertia body 1 is forced to oscillate from its original position against the gravitational force maintaining it stationary. In connection with the resultant oscillating movement of the inertia body 1 mentioned above, the head portion 2 of the inertia body 1 being successively inclined from the substantially horizontal position, pushes the free end of the lever 6 in the upward direction in spite of the resilient force of the spring 4 urging downward on upper side thereof and thereby, the latch shaft 8 fixedly secured by the other end of the lever 6 and the latch 7 mounted on the forward end of the latch shaft 8, as a whole, being forcibly turned counterclockwise, so that the frictional contact between the pawl 18 and the outer circumference 7' of the latch 7 is released as shown in FIG. 3, and thus, the electrical connecting member 14 is pivotally moved counterclockwise with respect to the pin 19 by means of the spring force of the internal spring 20.

As a result, the movable, contacting portion 17 of the electrical connecting member 14 is moved out of contact with the fixed electrical connector 21.

Naturally, if the inertia body 1 is upwardly accelerated through the accidental turnover of the motor vehicle, the free end of the lever 6 is lifted by the turnover of the inertia body 1 itself while the other end is secured to the latch shaft 8 and thus, likewise, the series of successively related movements are brought about for effecting the mechanical operation of the disclosed inertia switch assembly.

As specifically shown in FIG. 4, just after the circuit has been opened by the sudden oscillating movement of the inertia body 1, not only is the further pivotal movement or the rotational movement of the electrical connecting member 14 with respect to the pin 19 prevented by the stop 23, but also the inertia body 1 is returned to an original, stationary position through the resilient force of the spring 4, with its head portion **4*a* being pushed toward the head portion 4*a* so as to permit it to rest on the seat 3**.

When the device of the present invention is to be actuated from the resultant open circuit state to the normally closed circuit state, the manual driving of the handle 16 in the clockwise direction with respect to the pivotal center 19, which is specifically shown by an arrow B in FIG. 4, causes the electrical connecting member 14, as a whole, to rotate clockwise, with the internal spring 20 secured thereto being simultaneously stretched until the movable, electrically connecting portion 17 contacts the fixed electrical connector 21.

Furthermore, following the movement of the electrical connecting member 14 described above, the pin 19 is slightly lower along the circumference (not shown) of a circle having the pin 11 as a center so that the pawl 18 of the electrical connecting member 14 causes the latch 7 to be frictionally driven to rotate counterclockwise by the forward edge of the pawl 18 until said forward edge of the pawl 18 is again positioned at the side circumference 7' of the semicircular configuration thereof against the resilient force of the spring 4. Once the pawl 18 occupies the position described above, the counterclockwise pivotal or rotational movement of the electrical connecting member 14 with respect to the pin 19 which is due to the internal spring 20 is stopped. As a result the circuit including the inertia breaker of the present invention is maintained in a closed state, even after the force for driving the handle 16 is discontinued.

Furthermore, the amount of force required to move the inertia body can be adjusted since it depends on the specific gravity of the inertia body and the adjustable resilient force of the spring through the adjustment of the screw as described above.

The circuit breaker can be manually placed in an open or closed circuit state by simply operating the handle 16 which is connected to the electrical connecting member 14.

Consequently, since the inertia breaker of the present invention does not include any electrical circuits for controlling the ON-OFF actuation of the movable, electrical connector 21, the highly reliable inertia breaker or the electric circuit breaker, which avoids any technical defects resulting from the snapping or disconnection of the internal wire has been provided.

Although the present invention has been fully described by way of example with reference to the accompanying drawings, it is to be noted that various changes and modifications will be apparent to those skilled in the art. Therefore, unless such changes and modifications otherwise depart from the scope of the present invention, they should be construed as being included therein.

What is claimed is:

1. An electric circuit breaker for use in a motor vehicle and the like to instantaneously break an electric circuit, said electric circuit breaker comprising:

(a) a casing;

(b) an internal connecting member pivotally mounted on said casing, and urged in one direction with respect to a pivotal center and having a pivotal shaft extending therethrough;

(c) a latching member mounted on an outer end of said pivotal shaft and located adjacent to said internal connecting member;

(d) a lever secured to said pivotal shaft at one end of said lever;

(e) an inertia body means located at the other end of said lever and held in a rest position by said lever, said lever being forced down by an urging means which is located above said inertia body means with said lever end interposed between said urging means and said inertia body means, said inertia body means operable to cause said lever end to move in an upward direction against said urging means thereby unlatching said latching member when vertical forces are applied to said inertia body means;

(f) an electrical connecting member pivotally mounted on one end of said internal connecting member, said electrical connecting member having a cut out portion at one end for engaging said latching member and having a movable electrical connecting portion at a second end, said engagement between said cut out portion of said electrical connecting member and said latching member being released whenever said inertia body means causes said latching member to unlatch by moving the other end of said lever in an upward direction;

(g) a fixed electrical connector mounted on said casing for closing the circuit when said electrical connecting member is latched so that said moveable electrical connecting portion at said second end of said electrical connecting member contacts said fixed electrical connector; and (h) a handle connected to said electrical connecting member for manually re-engaging said electrical connecting member and said latching member after said electric circuit breaker has been tripped.

2. An electric circuit breaker as claimed in claim 1 further comprising:

(a) adjustable seating means for causing said inertia body to be held in said rest position, said adjustable seating means further comprising: a seat further provided with an aperture and secured to said casing at least at one side edge thereof, said inertia body means having a head portion resting on said seat and a shaft interconnecting said head portion and a lower portion of said inertia body which loosely extends through said aperture, said urging means being a spring member for urging said head portion downward with said other end of said lever being interposed between one end of said spring member and said head portion; and (b) a threaded member extending through said casing and having a spring receiver at a forward end adjacent the other end of said spring member for adjusting the urging force of said spring member.

3. An electric circuit breaker as claimed in claim 1, further comprising:

(a) a coil spring means for connecting a lower portion of one end of said electrical connecting member to said pivotal center of said internal connecting member for urging said moveable electrical connecting member away from said fixed electrical connector; and (b) means for urging said moveable electrical connecting member into contact with said fixed electrical connector, further comprising: a leaf spring mounted on said casing and engaging said moveable electrical connecting member at its lower portion for urging said moveable connecting member into contact with said fixed electrical connector.

4. An electric circuit breaker as claimed in claim 1 wherein said engaging portion of said electrical connecting member has a pawl thereon having an edge portion; and said latching member has a semi-circular cross section including a side surface for frictionally engaging said pawl when said edge portion is directed upward.

5. An electric circuit breaker as claimed in claim 4, wherein said electric circuit breaker further comprises: a first stop mounted on said casing for stopping said electrical connecting member when said edge portion of said pawl of said electrical connecting member is disengaged from said latching member and said electrical connecting member is pivotally moved downward into an open state.

6. An electric circuit breaker as claimed in claim 5, wherein said casing has a second stop for said internal connecting member for stopping said internal connecting member when it is pivotally moved in an upward direction following a pivotal movement of said electrical connecting member downward into an open state.

* * * * *